US006598422B1

(12) United States Patent
Smith

(10) Patent No.: US 6,598,422 B1
(45) Date of Patent: Jul. 29, 2003

(54) ENERGY CONSERVING REFRIGERANT FLOW PROCESSOR

(75) Inventor: Johnny E. Smith, Selma, TX (US)

(73) Assignee: Echelon International, Inc., Pleasanton, CA (US)

( * ) Notice: Subject to any disclaimer, the term of this patent is extended or adjusted under 35 U.S.C. 154(b) by 0 days.

(21) Appl. No.: 10/160,151

(22) Filed: Jun. 4, 2002

(51) Int. Cl.[7] ..... F25B 39/04
(52) U.S. Cl. ..... 62/509; 62/511
(58) Field of Search ..... 62/509, 511, 527, 62/5, 324.6, 498

(56) References Cited

U.S. PATENT DOCUMENTS 5,426,956 A * 6/1995 Phillippe ..... 62/509
5,724,830 A * 3/1998 Otis et al. ..... 62/509

* cited by examiner

*Primary Examiner*—Chen Wen Jiang
(74) *Attorney, Agent, or Firm*—Harris Zimmerman

(57) ABSTRACT

A refrigerant flow processor has a vessel with an inlet for receiving recirculating refrigerant from a motor driven compressor and a condenser and having an outlet for returning the refrigerant to an evaporator through an expansion valve. The vessel is configured to establish a vortexing motion of liquefied refrigerant as it travels from the inlet to the outlet. A helical flow guiding component at the vessel outlet causes a highly turbulent flow within the conduit which connects the outlet to the expansion valve. The flow processor reduces energy consumption and operating cost by reducing the load on the motor driven compressor.

12 Claims, 3 Drawing Sheets

FIG. 2
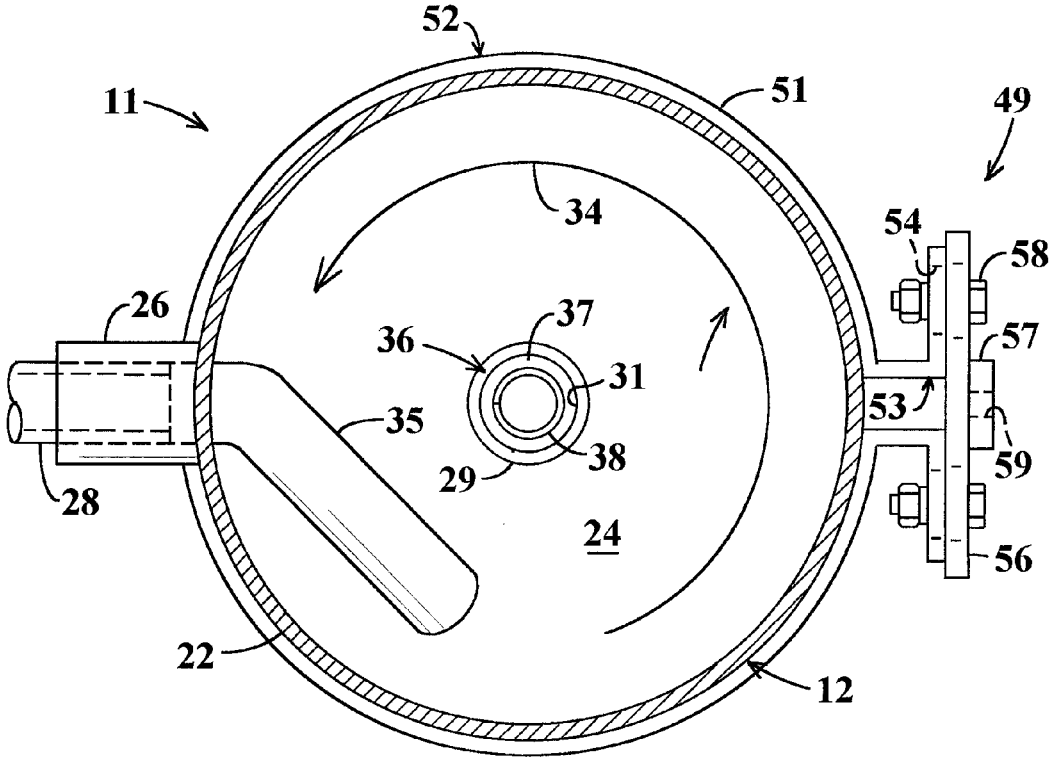
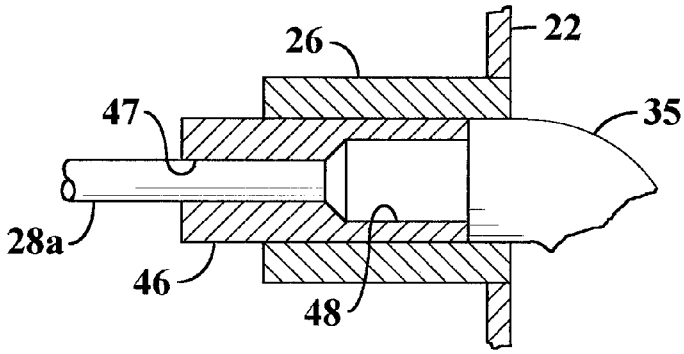
FIG. 4

ENERGY CONSERVING REFRIGERANT FLOW PROCESSOR

BACKGROUND OF THE INVENTION

This invention relates to heat exchanging systems in which a recirculating fluid refrigerant absorbs heat at an evaporator and releases heat at a condenser. More particularly the invention relates to apparatus for processing the refrigerant flow between the condenser and the evaporator in order to enhance the efficiency of the system.

Heat exchanging systems to which the invention is applicable include refrigerating systems, air conditioning systems and heat pumping systems among other examples. Systems of this kind have a motor driven compressor which pressurizes gaseous fluid that is received from an evaporator coil. The pressurizing raises the temperature of the fluid which is then transmitted to a condenser coil. The fluid releases heat into the region which is adjacent to thee condenser coil and condenses to liquid form as it cools. The condensed and cooled fluid is then returned to the evaporator coil where it expands and absorbs more heat from the region adjacent to the evaporator coil. Thus heat removed from the region adjacent to the evaporator coil is transferred to the region adjacent to the condenser coil.

Operation of the motor which drives the compressor consumes costly energy. Energy can be saved and operating costs can be reduced by increasing the thermodynamic efficiency of the system. It has heretofore been recognized that the energy which is required to transfer a given amount of heat at a given rate is affected by the compression ratio at the compressor and by the temperature of the condensed fluid as it enters the evaporator coil. Any steps which enable the compressor to deliver the fluid to the condenser coil at a lower head pressure increases efficiency. A lower fluid temperature at the inlet of the evaporator coil enables absorption of a greater amount of heat in the evaporator coil and thereby further increases efficiency.

It has also been recognized that the required compression ratio and also the temperature at the inlet of the evaporator coil can both be lowered by flow processing means in the flow path from the condenser coil to the evaporator coil. Prior U.S. Pat. No. 5,426,956 discloses flow processing means for this purpose, the specification and drawings of that patent being herein incorporated by reference. The flow processing means of that prior patent include a vessel which receives the condensed fluid from the condenser coil and delivers the fluid to the expansion valve and evaporator coil. The vessel holds a volume of condensed fluid that may otherwise be backed up into the condenser coil and thereby provides for increased condensation within the condenser coil. Further condensation takes place in the vessel itself. The increased condensation raises efficiency by lowering the discharge pressure at the outlet of the compressor. Heat transfer through the wall of the vessel results in further cooling of the condensed fluid and the heat transfer is enhanced by configuring the vessel to swirl the flow in a vortex as it travels toward the outlet of the vessel. Further cooling occurs by heat transfer through the wall of the conduit which delivers the condensed fluid from the vessel to the expansion valve and evaporator coil. In the apparatus of the above identified prior patent, a turbulator element at the outlet of the vessel enhances this further cooling by enhancing the rotational motion of the flow as it enters the conduit. Flow turbulence this kind increases heat loss through the conduit wall as the flow travels along the conduit thereby causing further cooling of the flow.

The presence of the turbulence inducing element in the flow path causes some back pressure which must be counteracted by the compressor. An object of this invention is to provide further energy saving and operating cost reduction by increasing turbulence in the flow which is discharged from the vessel and by reducing the back pressure which is created by the turbulence increasing component.

The present invention is directed to overcoming one or more of the problems discussed above.

BRIEF SUMMARY OF THE INVENTION

In one aspect the present invention provides a flow processing vessel having an inlet for receiving a flow of liquefied refrigerant from a refrigerant condenser having an outlet for delivering a flow of the liquefied refrigerant to an expansion device and evaporator through an outlet conduit. The vessel is configured to provide vortex rotation of the liquid as it travels downward from the inlet towards the outlet and has a turbulence enhancing component at the outlet for causing turbulence of the flow within the outlet conduit. The turbulence enhancing component has a flow guiding member with a helical inner surface that extends vertically within the flow at the outlet and which is oriented to impart rotational motion to the flow as it passes downward through the outlet.

In another aspect of the invention, a refrigerant flow processor includes a vessel forming an upright cylindrical vortex chamber and having a fluid inlet at an upper region thereof and a fluid outlet at the center of a bottom portion thereof. A flow delivery tube extends from the fluid inlet within the chamber, the tube being angled to direct incoming refrigerant towards a side region of the vortex chamber to reinforce rotation of fluid flow therein. An upright coupling sleeve extends downward from the fluid outlet and is adapted to receive a fluid outflow conduit. A vortex generator extends downward through the outlet and into an upper region of the coupling sleeve. The vortex generator has a flow guiding member with a helical inner surface which is curved to conform with the path of the liquid flow which is undergoing vortex rotation and descending through the outlet.

The invention reduces the discharge pressure at the compressor and lowers the temperature of the refrigerant which enters the expansion valve and evaporator. Power consumption by the motor driven compressor is thereby reduced to realize a substantial reduction in the operating cost of the system.

The invention, together with further objects and advantages thereof, may be further understood by reference to the following detailed description of a preferred embodiment of the invention and by reference to the accompanying drawings.

BRIEF DESCRIPTION OF THE DRAWINGS

FIG. 2 is a cross section view of the flow processor vessel taken along line 2—2 of FIG. 1.

FIG. 4 is an elevation section view of the fluid inlet region of the vessel of FIGS. 1 and 2 showing a modification which may be made to accommodate to fluid input conduits of different sizes.

DETAILED DESCRIPTION OF THE INVENTION

Figure 1:
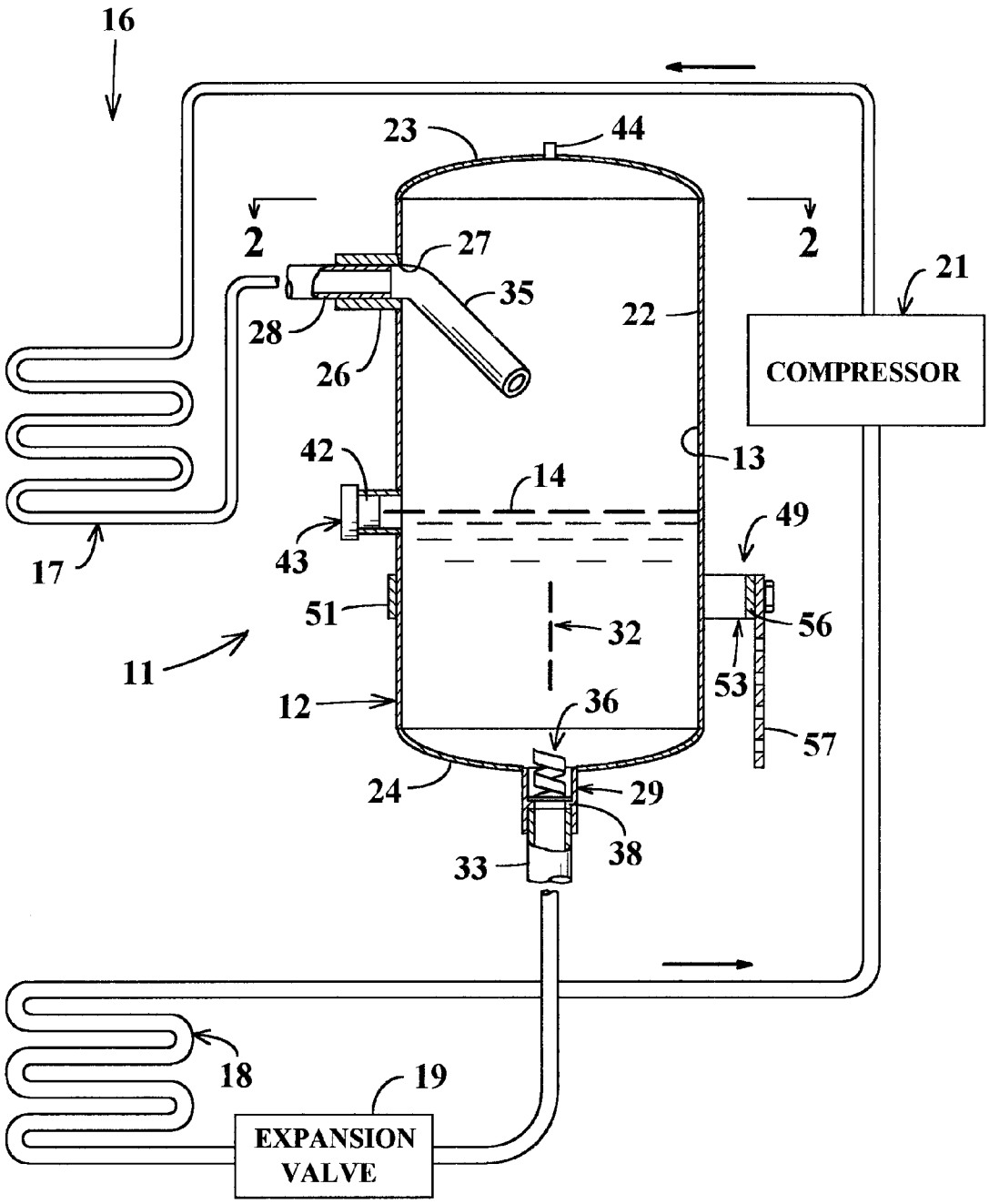
FIG. 1 is an elevation section view of a refrigerant flow processor vessel with associated components of a typical heat exchanging system being shown in schematic form.

Referring jointly to FIGS. 1 and 2 of the drawings, a refrigerant flow processor 11 embodying the invention includes a vessel 12 with an internal chamber 13 through which a recirculating refrigerant 14 passes. When installed in a typical heat exchanging system 16, the vessel 12 receives liquefied refrigerant 14 from a condenser coil 17 and delivers the refrigerant flow to an evaporator coil 18 through an expansion valve 19. Gasified refrigerant 14 from evaporator coil 18 is recirculated to condenser coil 17 through a compressor 21.

In this description land in the appended claims, the term "fluid" should be understood to refer to refrigerant 14 in either of its liquid or gaseous phases. The term "refrigerant" is used in keeping with common practice in the art although the heat pumping system 16 itself may variously be called a refrigerating system, an air conditioning system, a heat pump or be identified by various other terms depending on the function which it is adapted to serve.

In this example, vessel 12 is formed by an upright cylindrical shell 22 closed by upper and lower end caps 23 and 24 respectively which are of dished configuration. An upper coupling sleeve 26 extends outward from a fluid inlet opening 27 situated at an upper region of the chamber 13. The inflow conduit 28 which connects the vessel to condenser coil 17 extends into upper coupling sleeve 26 and is preferably microwire welded in place. The conduit 28 connection can be soldered or be established by other means but microwire welding provides greater assurance against leaks.

A lower coupling sleeve 29 extends downward from an outlet opening 31 in the lower end cap 24. Outlet opening 31 and lower sleeve 29 are centered on the vertical central axis 32 of the cylindrical shell 22. The outflow conduit 33 which delivers refrigerant 14 from vessel 12 to expansion valve 19 is fitted into a lower portion of the lower coupling sleeve 29 and is preferably microwire welded in place.

The above described configuration of the flow processor 11 creates a vortex in the downward flow of refrigerant 14 towards outlet 31. Coreolis force causes the liquid to rotate, as indicated by arrow 34 in FIG. 2, as it travels downward and inward towards the outlet 31. Referring again to FIGS. 1 and 2, the vortexing effect is enhanced by a fluid delivery tube 35 in chamber 13 which extends from upper coupling sleeve 26. Tube 35 is angle downwardly and sidewardly to direct the incoming stream of liquid 14 to a side region of the chamber 13 at which it reinforces the rotational motion of the liquid. The presence of the vessel 12 and the vortexing flow therein in the refrigerant flow path provides the efficiency increasing effects which have been previously described.

A vortex generator component 36 further enhances the rotational motion of the liquid as it enters the conduit 33 which delivers the flow to expansion valve 19. This causes the flow along outflow conduit 33 to be a highly turbulent flow with beneficial effects which will hereinafter be discussed.

Figure 3:
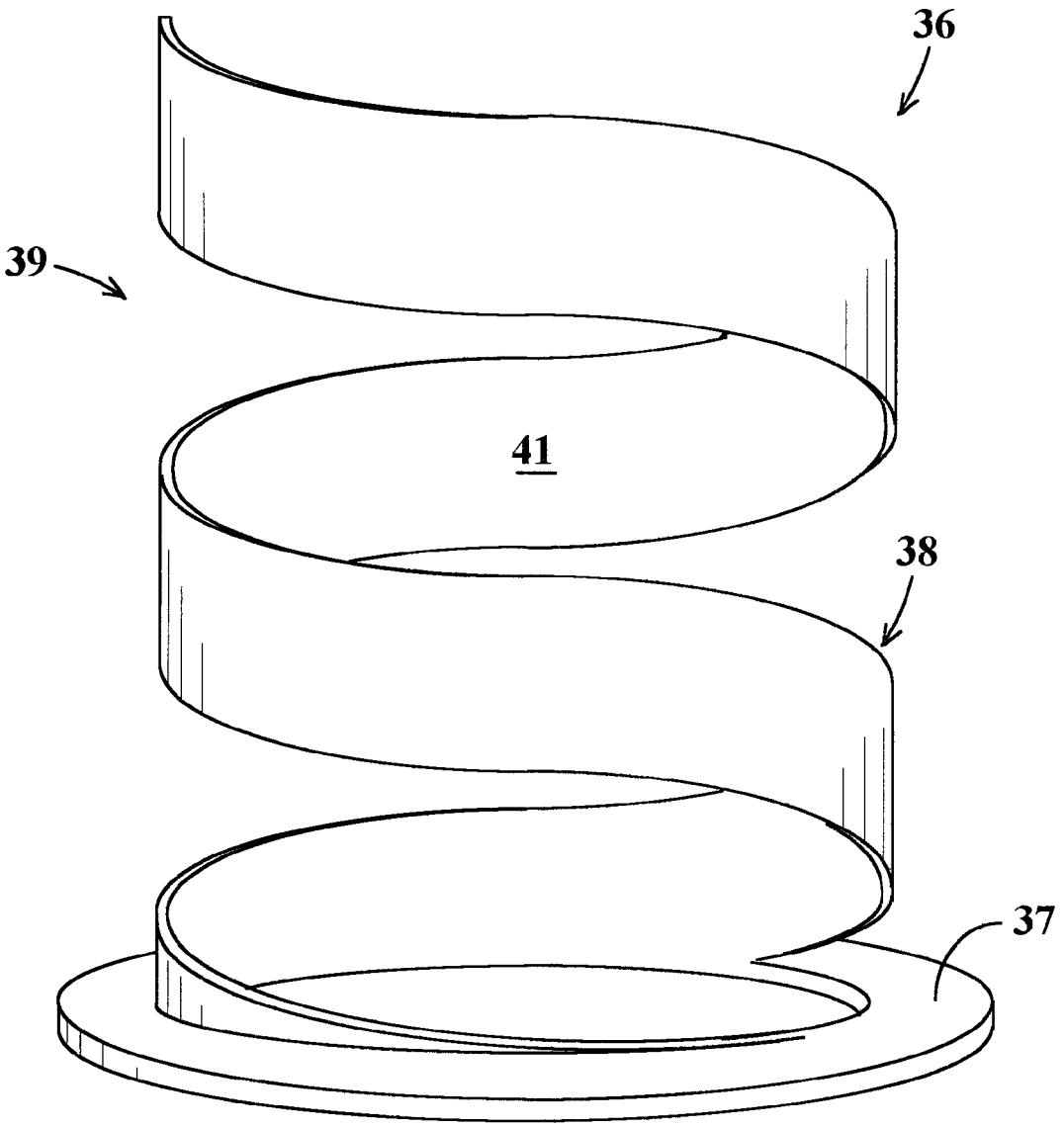
FIG. 3 is a perspective view of a turbulence enhancing component, termed a vortex generator, which is disposed at the outlet of the vessel of the preceding figures.

Referring to FIG. 3 in conjunction with FIG. 1, the vortex generator 36 has an annular base flange 37 which is seated against a conforming annular shelf 38 situated at a middle region of the lower coupling sleeve 29 above outflow conduit 33. A flow guiding member 38 of helical configuration extends upward from base flange 37 into the lowermost region of chamber 13. The pitch of the helix defined by flow guiding member 38 is sufficiently large to establish a helical slot 39 in the side wall of the vortex generator 36 that enables entry of fluid along the length of the flow guiding member. The helical flow guiding member 38 curves in the same angular direction that is traveled by the rotating liquid in chamber 13. Thus the helical inside surface 41 of member 38 intercepts incoming liquid and guides it downward while preserving and enhancing the rotation of the flow as it descends into outflow conduit 33.

Under optimum conditions, the angular component of the flow in conduit 33 may persist for a distance of around fifty feet. This distance is reduced by sharp turns or elbows in the conduit. Thus can be advantageous to provide a sizable radius of curvature at turns in instances where the conduit 33 extends along a non-linear path.

The inside diameter of the vortex generator 36 and the inside diameter of the shelf 38 against which it is seated are preferably at least as large as the inside diameter of outflow conduit 33. Thus the vortex generator 36 does not constrict the flow path of fluid entering the outflow conduit 33.

Referring to FIG. 1 in particular, the volume of liquid refrigerant 14 in vessel 12 normally extends to a level which is above the bottom of the vessel and below the outlet of fluid delivery tube 35 although the level may fluctuate temporarily in response to 6 changes in operating conditions. The vessel wall may be provided with a sight gauge 42 located at the normal level of the liquid refrigerant 14 to enable monitoring of the level. The sight gauge may be of the known form having a transparent window 43. The vessel 11 may also be provided with a fusible plug vent 44, preferably located in the upper end cap 23, of the type containing a small fusible plug (not shown) that melts to vent gaseous refrigerant if the temperature in the vessel should exceed a maximum operating value.

In this example of the invention, the fluid inflow conduit 28 from condenser coil 17 has an outside diameter corresponding to the inside diameter of the upper coupling sleeve 26. Referring to FIG. 4 in conjunction with FIG. 1, an adapter bushing 46 may be inserted into coupling sleeve 26 to enable installation of the same flow processor 11 in a system having an inflow line **28*a* of smaller diameter. Bushing 46 has an outside diameter conforming to the inside diameter of the upper coupling sleeve 26 and having a stepped axial passage. One end 47 of the axial passage has a diameter conforming to that of the relatively small inflow line 28*a*. The other end 48 of the axial passage has a larger diameter. Thus the bushing may be reversed end to end to receive an inflow line having a diameter intermediate between the inflow line 28*a* shown in FIG. 4 and the inflow line 28 shown in FIG. 1**.

Referring jointly to FIGS. 1 and 2, installation of the flow processor 11 is facilitated if it can be turned in any desired angular orientation in order to accommodate to fluid inlet conduits 28 that may extend in different directions. This can be provided for by use of a mounting fixture 49 which includes an omega clamp 51. The clamp 51 has somewhat flexible band 52 that substantially encircles vessel 12 and which has proximal ends 53 that are angled to extend outward from the vessel and then sidewardly. Ends 53 have slots 54 which enable fastening of clamp 51 to slotted arms 56 of a T-shaped mounting bracket 57 by bolts 58. Holes 59 in the bracket 57 enable it to be fastened to a wall or other structure at the installation site. Vessel 12 may bee turned within band 52 and be raised or lowered to align input coupling 26 with a fluid inlet conduit 28. Thereafter, ends 53 of band 52 are cinched together to clamp the vessel in place and bolts 58 are tightened.

As has been pointed out, vortex generator 36 substantially increases rotation of the liquid refrigerant flow as it travels along outflow conduit 33. The rotating flow, as contrasted with a straight forward laminar flow, is a form turbulent flow which reduces flow, resistance within the conduit and which increases further cooling of the flow by heat transfer through the wall of the conduit. Decreased flow resistance reduces the output pressure which compressor 21 must provide in order to circulate the refrigerant 14 and thereby provides energy savings. Increased cooling of the flow within conduit 33 lowers the temperature of fluid entering evaporator 18 and thereby effects further energy savings by increasing the efficiency of the evaporator.

While the invention has been described with reference to a specific embodiment for purposes of example, many modifications and variations are possible and it is not intended to limit the invention except as defined by the following claims.

What is claimed is:

1. A flow processing vessel having an inlet for receiving a flow of liquefied refrigerant from a refrigerant condenser and having an outlet for delivering a flow of the liquefied refrigerant to an expansion device and evaporator through an outlet conduit, said vessel being configured to provide vortex rotation of the liquid flow as it travels downward and inward from the inlet towards the outlet and having a turbulence enhancing component at said outlet for causing turbulence in the flow within the outlet conduit, wherein the improvement comprises:

said turbulence enhancing component having a flow guiding member at said outlet which member has a helical inner surface that extends vertically within the flow at said outlet and which is oriented to impart rotational motion to the flow as it passes downward through said outlet.

2. The apparatus of claim 1 wherein said helical inner surface of said flow guiding member is curved to conform with the path of the liquid flow which is undergoing said vortex rotation and descending through said outlet.

3. The apparatus of claim 1 wherein said helical inner surface of said flow guiding member has successive turns which are separated by a helical slot which extends along the flow guiding member.

4. The apparatus of claim 1 wherein said outlet includes an outlet opening centered in a bottom portion of said vessel, further including a lower coupling sleeve extending downward from said outlet opening and wherein said flow guiding member extends downward through said outlet opening and into said coupling sleeve, said flow guiding member having an external diameter which is smaller than an internal diameter of said lower coupling sleeve to provide an annular fluid receiving space therebetween.

5. The apparatus of claim 4 wherein said helical inner surface of said flow guiding member faces a flow guiding region within said flow guiding member and has successive turns which are separated by a helical slot which extends along the flow guiding member and which communicates said annular fluid receiving space with said flow guiding region.

6. The apparatus of claim 4 wherein said helical inner surface of said flow guiding member faces a flow guiding region within sail flow guiding member and has successive turns which are separated by a helical slot which extends along the flow guiding member and which communicates said annular fluid receiving space with said flow guiding region.

7. The apparatus of claim 4 wherein said flow guiding member includes an annular flange encircling said helical inner surface and which is seated on a conforming annular shelf within said lower coupling sleeve.

8. The apparatus of claim 1 wherein an upper coupling sleeve extends outward from said inlet of said vessel and a fluid inflow conduit extends into said upper coupling sleeve, said fluid inflow conduit having an outside diameter which is smaller than an inside diameter of said upper coupling sleeve, further including a reversible adapter sleeve extending into said upper coupling sleeve, said reversible adapter sleeve having a stepped axial passage with a first end proportioned to receive an inflow conduit having a first outside diameter and a second end proportioned to receive an inflow conduit having a different diameter.

9. The apparatus of claim 1 further including a mounting clamp having a flexible annular band extending substantially around said vessel, said band having outwardly angled ends adapted for fastening to arms of a T-shaped mounting bracket.

10. A refrigerant flow processor comprising:

a vessel forming an upright cylindrical vortex chamber and having a fluid inlet at an upper region thereof and a fluid outlet at the center of a bottom portion thereof, a flow delivery tube extending from said fluid inlet within said chamber, said tube being angled to direct incoming refrigerant towards a side region of said vortex chamber to reinforce rotation of fluid flow therein, an upright lower coupling sleeve extending downward from said fluid outlet and being adapted to receive a fluid outflow conduit, and a vortex generator which extends downward through said outlet and into an upper region of said lower coupling sleeve, said vortex generator having a flow guiding member with a helical inner surface which is curved to conform with the path of the liquid flow which is undergoing vortex rotation and descending through said outlet.

11. The apparatus of claim 10 wherein said helical inner surface of said flow guiding member has successive turns which are separated by a helical slot which extends along the flow guiding member and which extends down into said coupling sleeve.

12. The apparatus of claim 10 further including a fluid outflow conduit which extends into a lower portion of said coupling sleeve, said vortex generator having an internal diameter which is at least as large as the internal diameter of said fluid outflow conduit.

* * * * *